US008115392B1

(12) United States Patent
Karlsson et al.

(10) Patent No.: US 8,115,392 B1
(45) Date of Patent: Feb. 14, 2012

(54) DEVICE FOR GENERATION OF MICROWAVES

(75) Inventors: Magnus Karlsson, Karlskoga (SE); Fredrik Olsson, Örebro (SE)

(73) Assignee: Bae Systems Bofors AB, Karlskoga (SE)

( * ) Notice: Subject to any disclaimer, the term of this patent is extended or adjusted under 35 U.S.C. 154(b) by 662 days.

(21) Appl. No.: 10/584,563

(22) Filed: May 31, 2007

(30) Foreign Application Priority Data

Jun. 1, 2006 (SE) ..... 0601210

(51) Int. Cl.
*H01J 25/12* (2006.01)
*H01J 23/05* (2006.01)

(52) U.S. Cl. ..... 315/5.11; 315/39.67

(58) Field of Classification Search ..... 315/5, 5.11, 315/5.12, 5.18, 5.19, 39.67
See application file for complete search history.

(56) References Cited

U.S. PATENT DOCUMENTS 4,751,429 A * 6/1988 Minich ..... 315/5

OTHER PUBLICATIONS

Crawford, Mark et al, "Cylindrically-Symmetric Virtual Cathode Oscillator High-Power Microwave Source," 9th IEEE Internatinal Pulsed Power Conference, Jun. 1993, pp. 608-611.*

Mankowski, J. et al, "Efficiency Results from a Coaxial Vircator Using a Simple Feedback Technique," 14th IEEE International Pulsed Power Conference, Jun. 2003, pp. 455-458.*

Alyokhin, B. V. et al, "Theoretical and Experimental Studies of Virtual Cathode Microwave Devicesw," IEEE Transactions on Plasma Science, vol. 22, No. 5, Oct. 1994, pp. 945-959.*

Shao, Hao et al, "Characterization of Modes in Coaxial Vircator," IEEE Transactions on Plasma Science, vol. 34, No. 1, Feb. 2006, pp. 7-13.*

Luo et al. "Studies on Radial Three-Cavity Coaxial Virtual Cathode Oscillator." Antennas, Propagation & EM Theory, 1SAPE'06, 7th International Symposium, Oct. 2006, pp. 1-4.

Shao et al. "Numerical Simulation Studies of Coaxial Vircators." Northwest Institute of Nuclear Technology, pp. 792-795.

Woolverton et al. "Diode Polarity Experiments on a Coaxial Vircator." Pulsed Power Conference, Digest of Technical Papers, 11th IEEE International, vol. 1, Jun. 29-Jul. 2, 1997, pp. 759-764.

* cited by examiner

*Primary Examiner* — Gregory C Issing
(74) *Attorney, Agent, or Firm* — Jacobson Holman PLLC

(57) ABSTRACT

The invention relates to a device for generation of microwaves comprising a coaxial virtual cathode oscillator (1) with an outer cylindrical tube forming a cathode (2) and connected to a transmission line (8) for feeding the cathode (2) with voltage pulses, and an inner cylindrical tube, at least partially transparent for electrons, forming an anode (3) and connected to a transmission device (8) for outputting microwave radiation generated by the formation of a virtual cathode (4) inside an area enclosed by the anode. Through the introduction of a centre conductor (5) arranged to coincide with the centre axle (19) for the cathode's (2) outer cylindrical tube and in electrical connection with the tube a device for generation of microwaves is obtained having improved energy efficiency and better broadband performance.

17 Claims, 3 Drawing Sheets

DEVICE FOR GENERATION OF MICROWAVES

Figure 1:
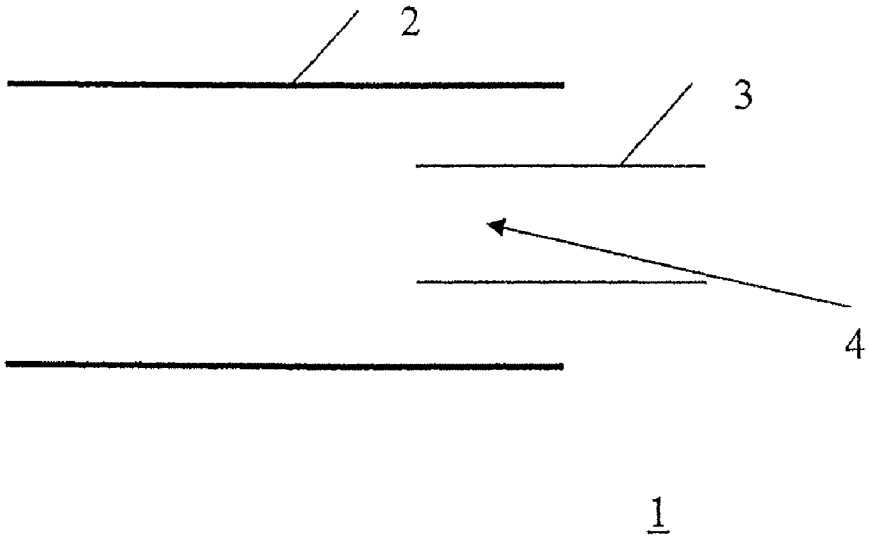
Fig. 1 Prior Art

The present invention relates to a device for generation of microwaves comprising a coaxial virtual cathode oscillator (vircator) with a rotation symmetrical, outer, cylindrical tube around a central axis forming a cathode and connected to a transmission line for supplying the cathode with voltage pulses, and an inner cylindrical tube, at least partially transparent for electrons, forming an anode and connected to a transmission device for outputting microwave radiation generated by the formation of a virtual cathode inside an area enclosed by the anode.

Microwave generators of this type can, among other uses, be used to knock out electronics using the high peak output that can briefly be generated.

A device as described in the first paragraph is essentially previously known from U.S. Pat. No. 4,751,429 and the article "Numerical Simulation Studies of Coaxial Vircators", by Hao Shao, Guozhi Liu, Zhimin Song, Yajun Fan, Xiaoxin Song, Northwest Institute of Nuclear Technology, P 792-795.

Microwave sources with virtual cathode oscillators are generally narrow-band and have low degrees of efficiency. It is therefore desirable to be able to increase the device's degree of energy efficiency and bandwidth.

The purpose of the present invention is to obtain a device for generation of microwaves with improved degree of energy efficiency and better broadband performance.

The purpose of the invention is achieved through a device for generation of microwaves in accordance with the first paragraph wherein the cathode comprises a cylindrical centre conductor arranged to coincide with the centre axle for the outer cylindrical tube and in electrically conductive connection with the outer cylindrical tube.

The generated electromagnetic radiation's frequency is primarily determined by the relation between the anode and cathode as well as drive voltage to the device. The bandwidth of the generated electromagnetic radiation is some few percent, but there are in addition accentuated harmonics in the frequency spectrum that are generated at even multiples of the fundamental frequency. By introducing the cylindrical centre conductor in the centre of the outer cylindrical tube and electrically connecting the tube with the centre conductor, a broadband radiation source is created. The generated electromagnetic radiation contains partly a component generated by the virtual cathode as well as a component with lower frequency content generated by a transient process in the drive voltage source that feeds the device cathode with voltage pulses. The lower frequency component has a wider frequency band width than the higher frequency component.

The cylindrical centre conductor preferably has a circular cylindrical form. This form contributes to a symmetric design. One design proposal has a hollow centre conductor. Making the centre conductor hollow reduces both weight and consumption of materials without jeopardizing device function.

According to one favourable embodiment of the device, the circular-cylindrical centre conductor is at least partially surrounded by a dielectric material connected with the anode's waveguide for outputting microwave radiation. The dielectric material can then be composed of plastic material. Alternatively, the dielectric material can be composed of ceramic material.

According to another favourable embodiment of the device the one end of the cylindrical centre conductor is electrically and mechanically connected to a central part of a first electrically conductive wall arranged on the inside of the cathode's cylindrical tube transverse to the longitudinal direction of the tube at a distance from the anode's, for the electron's at least partially transparent, tube. By introducing such a wall the virtual cathode can be strengthened through feedback.

According to an additional favourable embodiment of the device another electrically conductive wall is arranged on the outside of the anode's, for the electron's at least partially transparent, tube transverse to the longitudinal direction and at a distance from the cathode cylindrical tube. Introduction of this wall and particularly together with a wall in accordance with the design in the previous paragraph strengthens the virtual cathode additionally through feedback.

The cylindrical centre conductor can substantially consist of metal, such as aluminium, copper, or steel.

A high voltage generator connected to the cathode's transmission line is suitable for feeding the device cathode. A suitable high voltage generator is a Marx generator. Additionally, the wave guide for output of the microwave radiation is connected to an antenna. The antenna can be, for example, a horn antenna. In a proposed embodiment the device anode is composed, at least partially, of mesh. As an alternative, the anode can partially be composed of a thin foil.

The transmission device for outputting microwave radiation can be shaped in different ways. In accordance with a proposed embodiment, the transmission device for outputting microwave radiation to a load comprises at least parts of the inner cylindrical tube and a dielectric arranged in the inside of the tube. In accordance with another proposed design the transmission device for outputting microwave radiation to a load comprises a waveguide arranged between the anode and the load. Both embodiments have been found to be favourable for outputting broadband microwave radiation.

The present invention will be described in more detail below with reference to appended drawings, in which:

FIG. 1 schematically depicts an example of a known coaxial virtual cathode oscillator comprised in a device for generation of microwaves.

Figure 2:
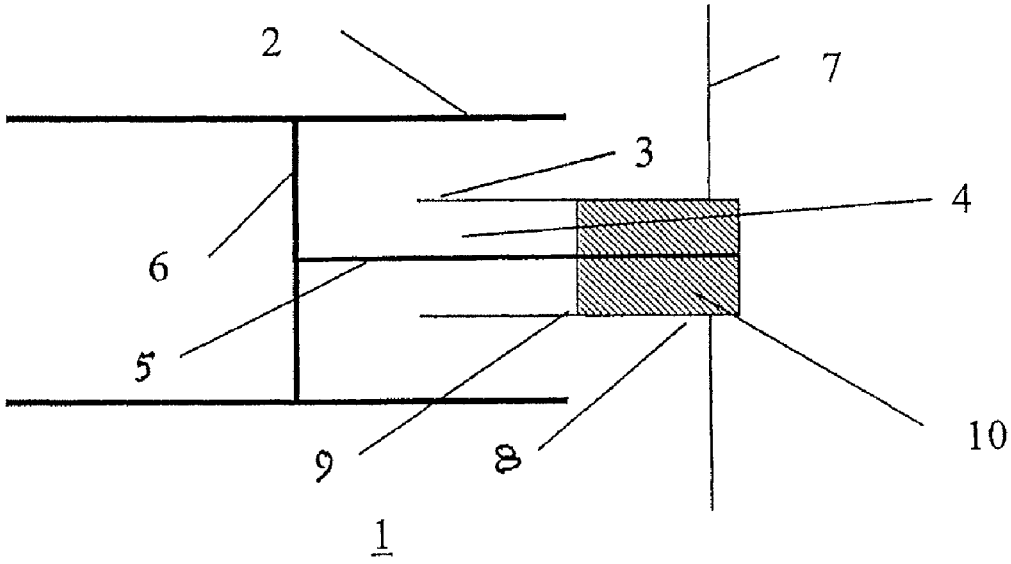

FIG. 2 schematically depicts a first example of a coaxial virtual cathode oscillator in accordance with the present invention comprised in a device for generation of microwaves.

Figure 3:
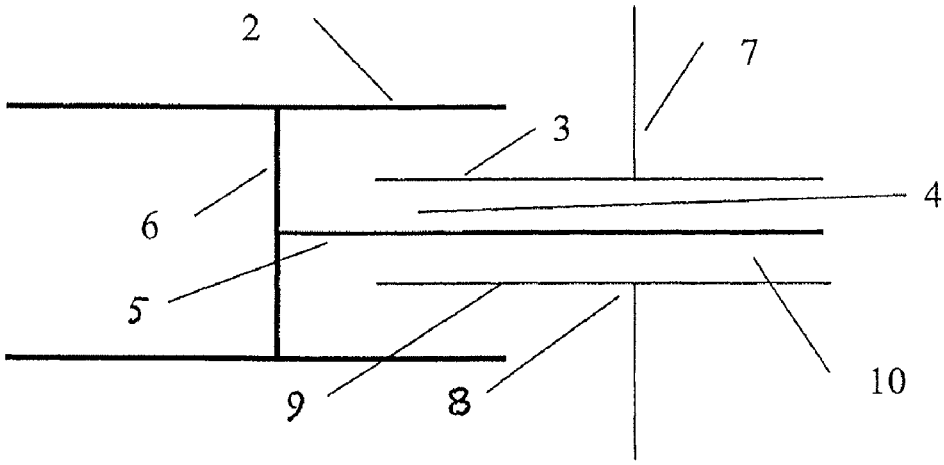

FIG. 3 schematically depicts a second example of a coaxial virtual cathode oscillator in accordance with the present invention comprised in a device for generation of microwaves.

Figure 4:
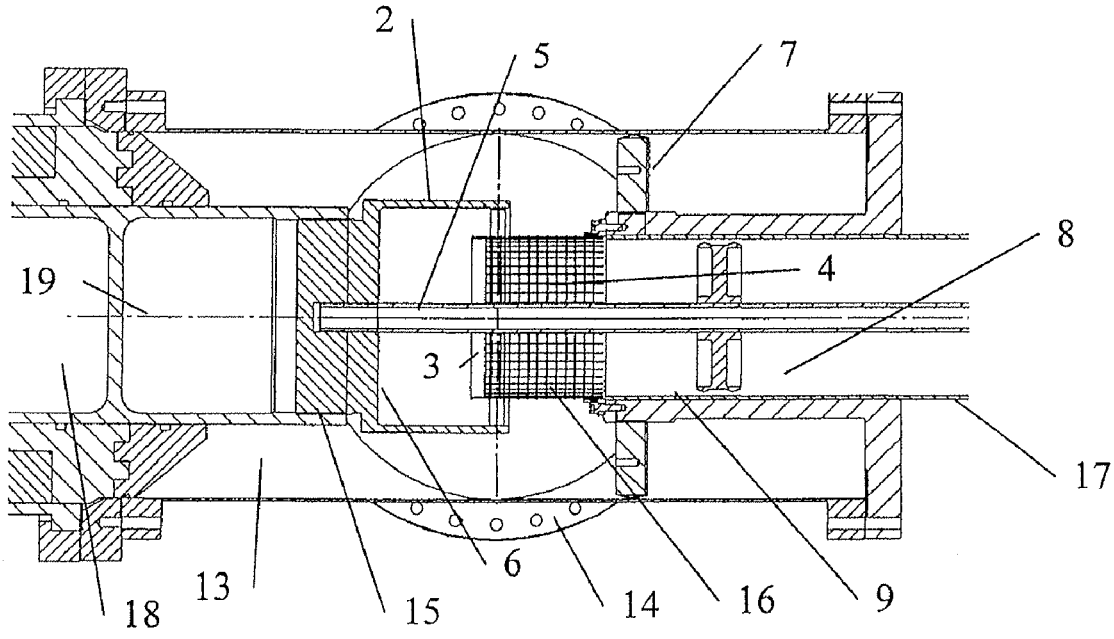

FIG. 4 schematically depicts a more detailed example of a coaxial virtual cathode oscillator in accordance with the present invention comprised in a device for generation of microwaves.

Figure 5:
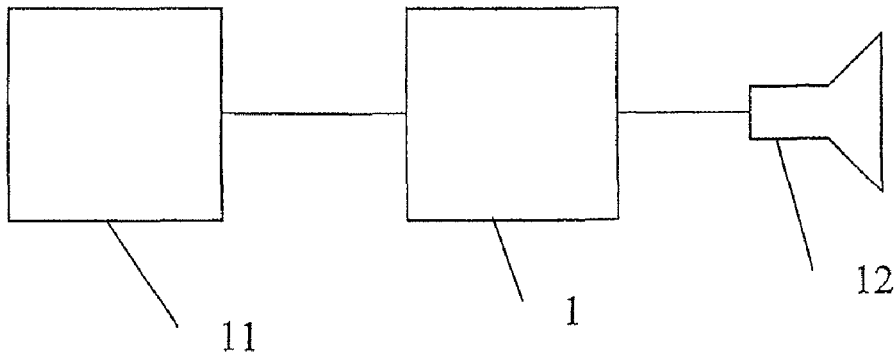

FIG. 5 schematically in block form depicts a complete device for generation of microwaves containing a coaxial virtual cathode oscillator in accordance with the present invention.

The known coaxial virtual cathode oscillator 1 schematically depicted in FIG. 1 contains a cathode 2 in the form an outer cylindrical tube and an anode 3 in the form of an inner cylindrical tube. The cathode oscillator is a very simple geometric design and is based on a so-called virtual cathode 4 occurring inside of the anode under certain conditions.

FIG. 2 depicts on the schematic level a modification of the known coaxial virtual cathode oscillator, vircator, for improving efficiency and bandwidth. In accordance with this embodiment a centre conductor 5 is arranged to coincide with the centre axle (not depicted) for the cathode 2 in the form of an outer cylindrical tube. The centre conductor 5 is electrically connected with the cathode 2 and in the embodiment depicted in FIG. 2 via an electrically conductive structure 6 arranged on the inside of the anode's cylindrical tube and transverse to the tube's longitudinal direction. The structure's 6 electrically conductive wall creates feedback that can contribute to strengthening the virtual cathode 4. An additional conductive structure 7 in the form of an electrically conductive wall is for the same reason, to create feedback, arranged on the outside of the tube shaped anode 3 or thereto connected transmission device 8. The transmission device 8 is composed of a tube 9 with the end towards the cathode, partially transparent, forming the anode 3 and with the other end equipped with a dielectric material 10. The dielectric material can as a suggestion be composed of ceramic or plastic material. The centre conductor 5 connected to the cathode 2 of the device runs in the centre of the tube 9. The transmission device transmits the generated electromagnetic energy to the connected (not depicted) load in the form of, for example, an antenna structure.

Alternatively, the transmission device 8 can be designed with a waveguide between the anode 3 and the load present that leads the generated electromagnetic energy. FIG. 3 depicts a schematic embodiment. In it a transmission line is formed by the tube 9 and the centre conductor 5. The dielectric 10 in the tube 9 is in this case constituted by a vacuum.

The coaxial virtual cathode oscillator 1 can be included in a device for generation of microwaves depicted in FIG. 5 and comprising a high voltage generator 11 connected to the cathode oscillator input and an antenna 12 connected to the cathode oscillator output. The antenna can be a horn antenna.

The cathode oscillator with peripherals is depicted and described in more detail in reference to FIG. 4, both regarding design and function. Reference designations that correspond to previously described figures have been given the same reference designations in FIG. 4. As depicted in FIG. 4, the anode 3 and the cathode 2 are arranged in a vacuum chamber 13 with a connection 14 for a vacuum pump (not depicted in the figure). A screw joint 15 enables the adjustment of the structure's 6 distance to the anode 3 through rotation. A corresponding screw joint can be arranged for adjustment of the structure's 7 distance to the cathode 2. The anode 3 is equipped with a mesh 16 that is partially transparent to free, electrically charged particles. Alternatively, the anode can be composed of thin foil. The anode 3 passes to an outgoing waveguide 17, while the cathode 2 is fed by a transmission line 18. In accordance with the depicted embodiment, a hollow centre conductor 5 is arranged to coincide with the centre axle 19 for the cathode's 2 cylindrical tube. The centre conductor 5 extends at least from the structure 6 through the anode 3 to a transmission device 8.

The cathode oscillator's design is based on so-called virtual cathode that occurs under certain conditions. When a voltage pulse with negative potential is fed, for example by a Marx generator, via the transmission line 18 to the cathode 2, a high electric field occurs between the cathode 2 and the anode 3. This causes electrons to be field emitted from the cathode material. The electrons accelerate after that toward the anode structure and the majority of the electrons will even pass the anode and begin to decelerate. If certain conditions are met, a virtual cathode 4 will occur inside the anode structure. Because the process is strongly non-linear, the phenomenon that causes the microwave radiation to be generated occurs. The more detailed conditions for microwave generation are not described here because they are part of the competence for expert in the field. Under the correct conditions, very high output is generated for a short period with a typical magnitude of 50-100 ns prior to shortcircuiting. Generated microwaves are radiated from the cathode oscillator anode via the waveguide 17 connected to the anode that have essentially the same radius as the anode 3.

Through introduction of the centre conductor 5 a radiation source is achieved with a broader bandwidth. To improve generation of electromagnetic energy with broad frequency content, the centre conductor's 5 radius is adapted to drive voltage and the distance between the anode and the cathode. Adaptation can be performed through computation or testing, or both.

The present invention is not limited to the design examples described above, but can be subject to modification within the framework of the subsequent patent claims.

The invention claimed is:

1. Device for generation of microwaves comprising a coaxial virtual cathode oscillator with a rotation symmetrical, outer, cylindrical tube around a central axis forming a cathode and connected to a transmission line for supplying the cathode with voltage pulses, and an inner cylindrical tube, at least partially transparent for electrons, forming an anode and connected to a transmission device for outputting microwave radiation generated by the formation of a virtual cathode inside an area enclosed by the anode, wherein the cathode comprises a cylindrical centre conductor arranged to coincide with the centre axle for the outer cylindrical tube and in electrically conductive connection with the outer cylindrical tube.

2. The device as claimed in claim 1, wherein the cylindrical centre conductor has a circular-cylindrical form.

3. The device as claimed in claim 2, wherein the circular-cylindrical centre conductor is at least partially surrounded by a dielectric material disposed in the anode's waveguide for outputting microwave radiation.

4. The device as claimed in claim 3, wherein the dielectric material is composed of a plastic material.

5. The device as claimed in claim 3, wherein the dielectric material is composed of a ceramic material.

6. The device as claimed in claim 1, wherein the one end of the cylindrical centre conductor is electrically and mechanically connected to a central part of a first electrically conductive wall arranged on the inside of the cathode's cylindrical tube transverse to the longitudinal direction of the tube at a distance from the anode for the electrons at least partially transparent tube.

7. The device as claimed in claim 6, wherein another electrically conductive wall is arranged on the outside of the anode, for the electrons at least partially transparent tube transverse to the longitudinal direction and at a distance from the cathode cylindrical tube.

8. The device as claimed in claim 1, wherein the cylindrical centre conductor essentially consists of metal, such as aluminium, copper, or steel.

9. The device as claimed in claim 1, wherein the transmission line for feeding the cathode is connected to a high voltage generator.

10. The device as claimed in claim 9, wherein the high voltage generator is a Marx generator.

11. The device as claimed in claim 1, wherein the transmission device for outputting microwave radiation is connected to an antenna.

12. The device as claimed in claim 9, wherein the antenna is a horn antenna.

13. The device as claimed in claim 1, wherein the anode is composed, at least partially, of mesh.

14. The device as claimed in claim 1, wherein the anode is composed, at least partially, of a thin foil.

15. The device as claimed in claim 1, wherein the transmission device for outputting microwave radiation to a load comprises at least parts of the inner cylindrical tube as well as a dielectric arranged in the inside of the tube.

16. The device as claimed in claim 1, wherein the transmission device for outputting microwave radiation to a load comprises a waveguide arranged between the anode and the load.

17. The device as claimed in claim 1, wherein the centre conductor is hollow.

* * * * *